United States Patent [19]

Afifi et al.

[11] Patent Number: 4,544,928

[45] Date of Patent: Oct. 1, 1985

[54] MULTIFREQUENCY REFLECTOR ANTENNA

[75] Inventors: Mostafa S. Afifi, King of Prussia; Frank R. Chiappetta, Berwyn, both of Pa.

[73] Assignee: General Electric Company, Philadelphia, Pa.

[21] Appl. No.: 169,272

[22] Filed: Jul. 16, 1980

[51] Int. Cl.[4] ..... H01Q 1/28; H01Q 19/12

[52] U.S. Cl. ..... 343/781 P; 343/840; 343/914

[58] Field of Search ..... 343/777, 779, 781 P, 343/836, 840, 914, 912, 6 ND, 835, DIG. 2

[56] References Cited

U.S. PATENT DOCUMENTS 2,551,586 5/1951 Dobler et al. ..... 343/836
2,895,127 7/1959 Padcett ..... 343/840
3,696,435 10/1972 Zucker ..... 343/840
3,803,622 4/1974 Thornton ..... 343/914

*Primary Examiner*—Eli Lieberman
*Attorney, Agent, or Firm*—Allen E. Amgott

[57] ABSTRACT

A multifrequency antenna includes a main reflector for signals in a low frequency band. One or more portions of the main reflector are deformed to provide one or more auxiliary reflectors for signals in one or more higher frequency bands. The feed for the low frequency band is located axially of the main reflector, while the feeds for the higher frequency bands are offset to the side of the low frequency feed. The lateral and axial offsets of the vertex of an auxiliary high frequency reflector from the vertex of the main low frequency reflector and the focal length of the auxiliary high frequency reflector are selected to minimize the degradation of the performance in the low frequency band.

15 Claims, 14 Drawing Figures

FIG. 3
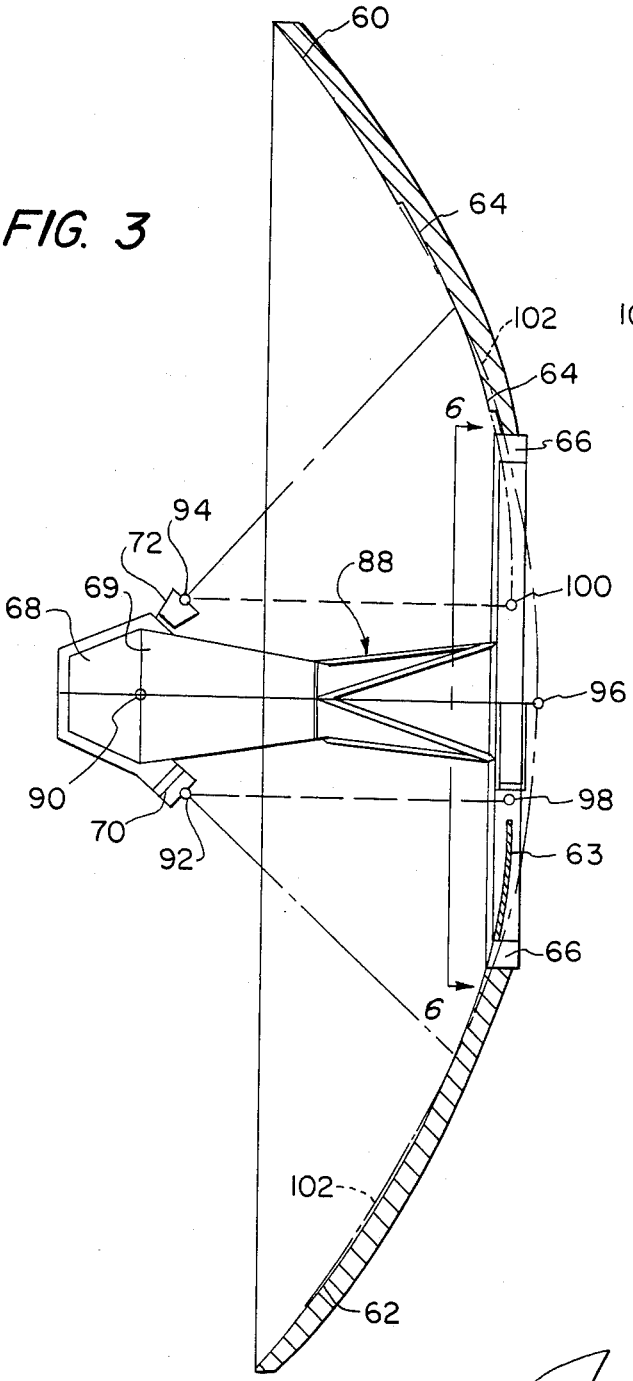
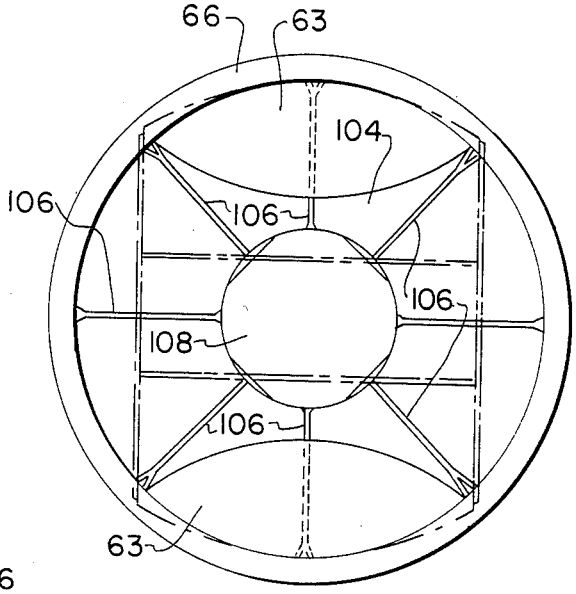
FIG. 6
FIG. 4
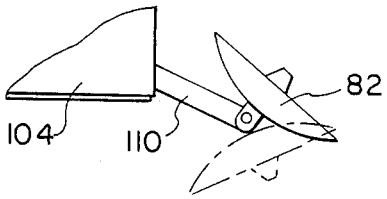
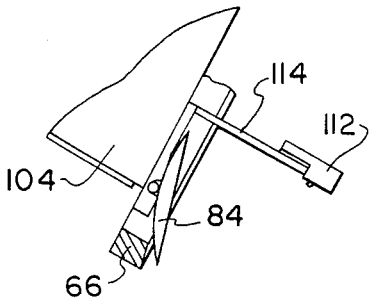
FIG. 5

(SHF) X-BAND-UHF ANTENNA
OPTIMUM CONF.

$$\Delta Z = \frac{X_c X + Y_c Y}{2F} - \left[Z_o + \frac{F_x Z_c}{F}\right] - Z\left(1 - \frac{F_x}{F}\right)$$

$$\text{RMS ERROR} = \sqrt{\sum_{\text{X-SURF}} (\Delta Z)^2 / N_{\Delta Z}}$$

MINIMUM RMS ERROR OF 1.8" (AT THE LOCATION OF THE SHF REFLECTOR)

| | | |
|---|---|---|
| OCCUR AT | $X_c = 21''$ | UHF (300mHz - 3GHz |
| | $Y_c = 0.0$ | SHF (3GHz - 30 GHz) |
| | $Z_c = 5''$ | |
| | $F_y = 71''$ | |
| | $F = 87.6$ | |

MULTIFREQUENCY REFLECTOR ANTENNA

BACKGROUND OF THE INVENTION

1. Field of the Invention

This invention relates to antennas employing single reflector configurations and, more particularly, to antennas of this character adapted for use simultaneously for a plurality of frequency bands, with the multiple main beams (at different frequencies) coincident, separate or scannable.

2. Description of the Prior Art

It has been proposed in the prior art, for coincident multiple beams, to use a single reflector for a pair of frequency bands from a pair of feeds. This has been achieved by employing dicroic frequency selective surfaces. Prior art systems of this type are disclosed, for example, in T. W. Leonard and L. R. Young, "Frequency Selective Surfaces," *AP-S International Symposium*, June 1977, pp. 560–563 and A. G. Cha, "Beam Squint in Large Ground Station Antennas," *AP-S International Symposium*, June 1977, pp. 538–540. Such frequency selective surfaces, however, require high manufacturing tolerances and employ multilayers which increase the losses and cost of the antennas.

Separate multiple beams, however, are generated from multiple separate feeds at the focal area of the reflector. These are restricted to minimum beam separation which corresponds to the sizes of the feeding arrangements. The degradation of the beams is a function of the beam separation and the multiplicity of the feeding arrangements. Detailed description of these systems are disclosed, in M. Afifi and P. Foldes, "Optimum Contiguous Multibeam Antenna Coverage," *AP-S International Symposium*, June 1980, pp. 74–77.

SUMMARY OF THE INVENTION

According to the present invention, a single reflector configuration is used by two or more separated microwave frequency bands, using separate clusters of feeds for unidirectional and/or separate directional high gain beaming. The separation between the high gain beams is not restricted by the sizes of the feeding arrangements and can be controlled to any fraction of a beam size by selection of the contour configuration of the reflector. The lowest frequency band, as an example, in the disclosure of the UHF band, uses the whole surface of the reflector which may be referred to as a "main reflector." In order to accommodate higher frequency bands (typically in the disclosure of the SHF band), portions of the main reflector are deformed, or adjusted in curvature, to form auxiliary reflectors to produce collimated beams directed to the same, or around the same, beaming direction as the low frequency band.

The curvature adjustments of the main reflector to form the auxiliary reflectors are selected to minimize the degradation of the performance of the main reflector for the lowest frequency band as evidenced by defocusing and sidelobe levels at the lowest frequency band. The locations of the auxiliary reflectors are optimized by an iteration procedure for selection of their focal lengths and the lateral and axial offsets of their vertices from the vertex of the main reflector to minimize the RMS error of the surface tolerances at the lowest frequency band. The displacement $\Delta Z$ of the surface of the main reflector in a Z-coordinate direction parallel to the axis of the main reflector to form an auxiliary reflector is governed by the equation:

$$\Delta Z = \frac{X_c X + Y_c Y}{2F} - \left[ Z_o + \frac{F_x Z_c}{F} \right] - Z\left(1 - \frac{F_x}{F}\right),$$

where X, Y and Z are the coordinates of points on the surface of the auxiliary reflector in mutually orthogonal X-coordinate, Y-coordinate, and Z-coordinate directions; $X_c$ is the distance in the X-coordinate direction of the focal point and vertex of the auxiliary reflector from the vertex of the main reflector; $Y_c$ is the distance in the Y-coordinate direction of the focal point and vertex of the auxiliary reflector from the vertex of the main reflector; $Z_c$ is the distance in the Z-coordinate direction of the vertex of the auxiliary reflector from the vertex of the main reflector; $Z_o$ is the position in the Z-coordinate direction on the main reflector from which the point on the auxiliary reflector, corresponding to the vertex of the auxiliary reflector, is displaced; and F and $F_x$ are, respectively, the focal lengths of the main and auxiliary reflectors. This results in an RMS error governed by the expression $$\sqrt{\Sigma_{X\text{-}SURF}(\Delta Z)^2/N},$$

where $\Sigma_{X\text{-}SURF}$ is a summation of the surface error of the auxiliary reflector and N is the number of sampling points taken on the auxiliary reflector to identify surface roughness.

The reflector of the invention may be formed as a mesh supported on a plurality of spaced ribs. The ribs are more closely spaced in the portions of the reflector having auxiliary reflectors to provide a larger rib density for the auxiliary reflectors.

The antennas of the present invention have a number of advantages. The multifrequency operation is obtained with relatively minor modifications of the surface of the main reflector at the locations of the auxiliary reflectors. The only frequency band which suffers degradation is the lowest frequency band. In contrast, the use of the frequency selective surfaces of the prior art causes degradation of performance for the high frequency band as well as for the low frequency band. In the present invention, the shaping of the reflector is not accompanied by critical tolerances of multilayer tuning problems as is the case with the frequency selective surfaces of the prior art. The present invention makes it convenient to use multifrequency feeding arrangements which are physically separated.

Additional objects, advantages and features of the invention will become more readily apparent from the following detailed description of preferred embodiments of the invention when considered in conjunction with the accompanying drawings.

BRIEF DESCRIPTION OF THE DRAWINGS

FIG. 3 is a section view taken along line 3—3 of FIG. 2.

FIG. 4 is a section view taken along line 4—4 of FIG. 2.

FIG. 5 is a section view taken along line 5—5 of FIG. 2.

FIG. 6 is a section view taken along line 6—6 of FIG. 3.

DETAILED DESCRIPTION

Because the antennas of the invention have particular utility on spacecraft, the two embodiments of the invention disclosed herein will be shown in a spacecraft environment. It is to be understood, however, that the invention is not limited to this context. Another similar typical application is an earth station attenna which handles the same frequencies.

Figure 1:
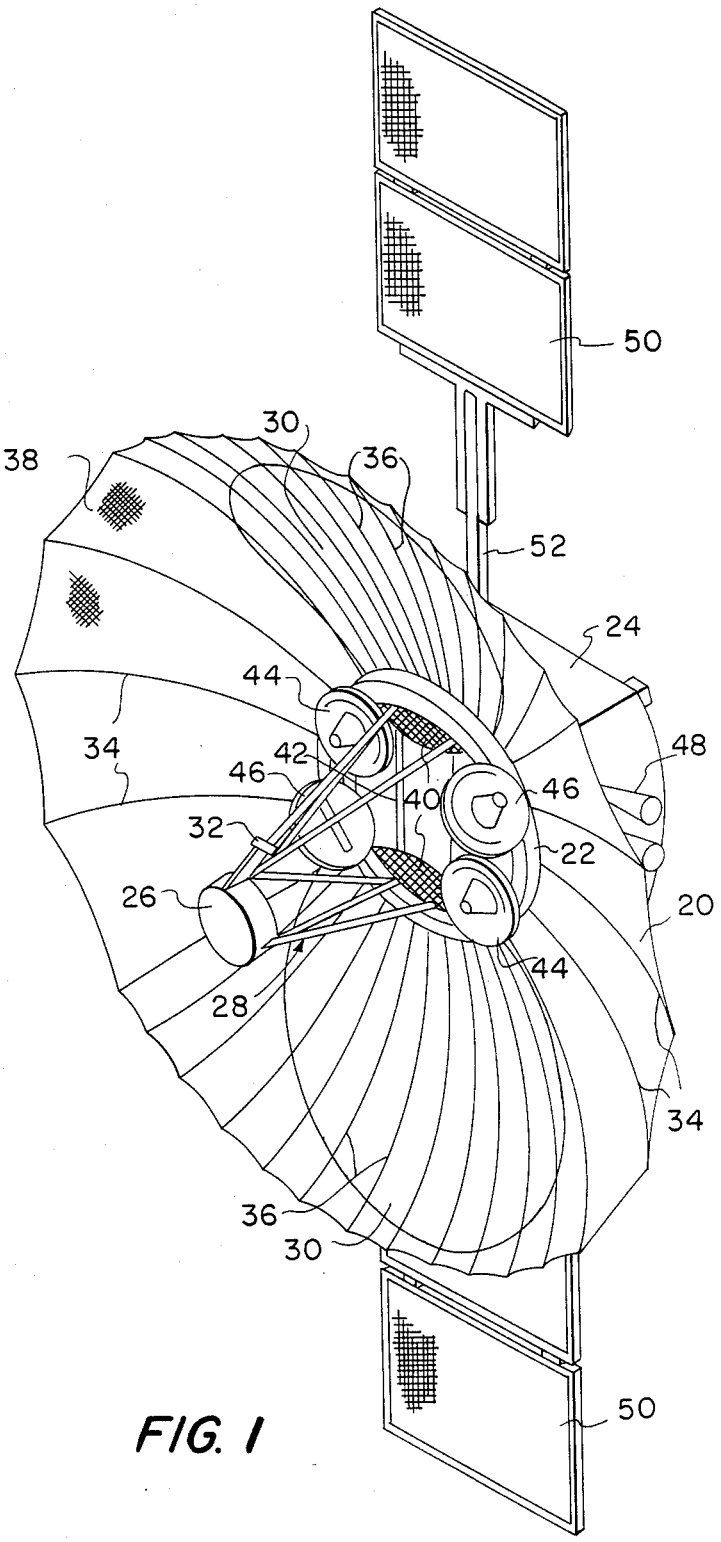
FIG. 1 is a perspective view showing an embodiment of the invention mounted on a spacecraft.

Referring to FIG. 1, an antenna of the invention includes a parabolic reflector 20 for the UHF band, which will be referred to hereinafter as the "main reflector." This reflector, which in a typical application will have a diameter of twenty-four feet, may be of the flexible rib type and will consist of a set of radial flexible ribs 34 and 36 covered by a conductive mesh 38. When not deployed as shown in FIG. 1, reflector 20 is stowed in a toroidal container 22 which is mounted on a spacecraft 24. A set of UHF feed horns are mounted in a cap or housing 26 supported on torus 22 by mounting struts 28. These feed horns illuminate the entire surface of main reflector 20 with signals in the UHF band.

In order to provide for signals in the SHF band, portions of the surface of main reflector 20 are deformed to provide a pair of diametrically opposed auxiliary reflectors 30. These reflectors are fed with SHF signals, of multiple beams, from assemblies of feed horns 32 mounted on the side of cap 26; only one of assemblies 32 are seen in FIG. 1. It will be observed that the ribs 34 are relatively widely spaced in portions of main reflector 20 which do not contain auxiliary reflectors 30; the mesh 18 on these portions of reflector 20 is relatively coarse. This rib spacing and mesh coarseness are satisfactory for signals in the relative low frequency UHF band. In the higher frequency SHF band, however, a closer rib spacing and a finer mesh are required. Thus, as seen in FIG. 1, ribs 36 in the portions of main reflector 20 corresponding to the location of auxiliary reflectors 30 are more closely spaced and have a greater rib density than ribs 34 in the remainder of main reflector 20. The mesh 38 on these portions of reflector 20 is relatively fine. Because the circles defining the edges of auxiliary reflectors 30 extend into the space within torus 22, reflectors 30 include fixed, rigid extensions 40 mounted on torus 22 and protruding into the central space of the torus. Also seen in this central space is a strut 42 of a mounting structure mounting torus 22 on spacecraft 24.

Additional antenna devices, which form no part of the present invention, are shown mounted on torus 22. These include earth links 44 and cross links 46. Spacecraft 24 has thrusters 48 and supports a pair of solar panel sets 50 on rotatable shafts 52, only one of which is seen.

Figure 2:
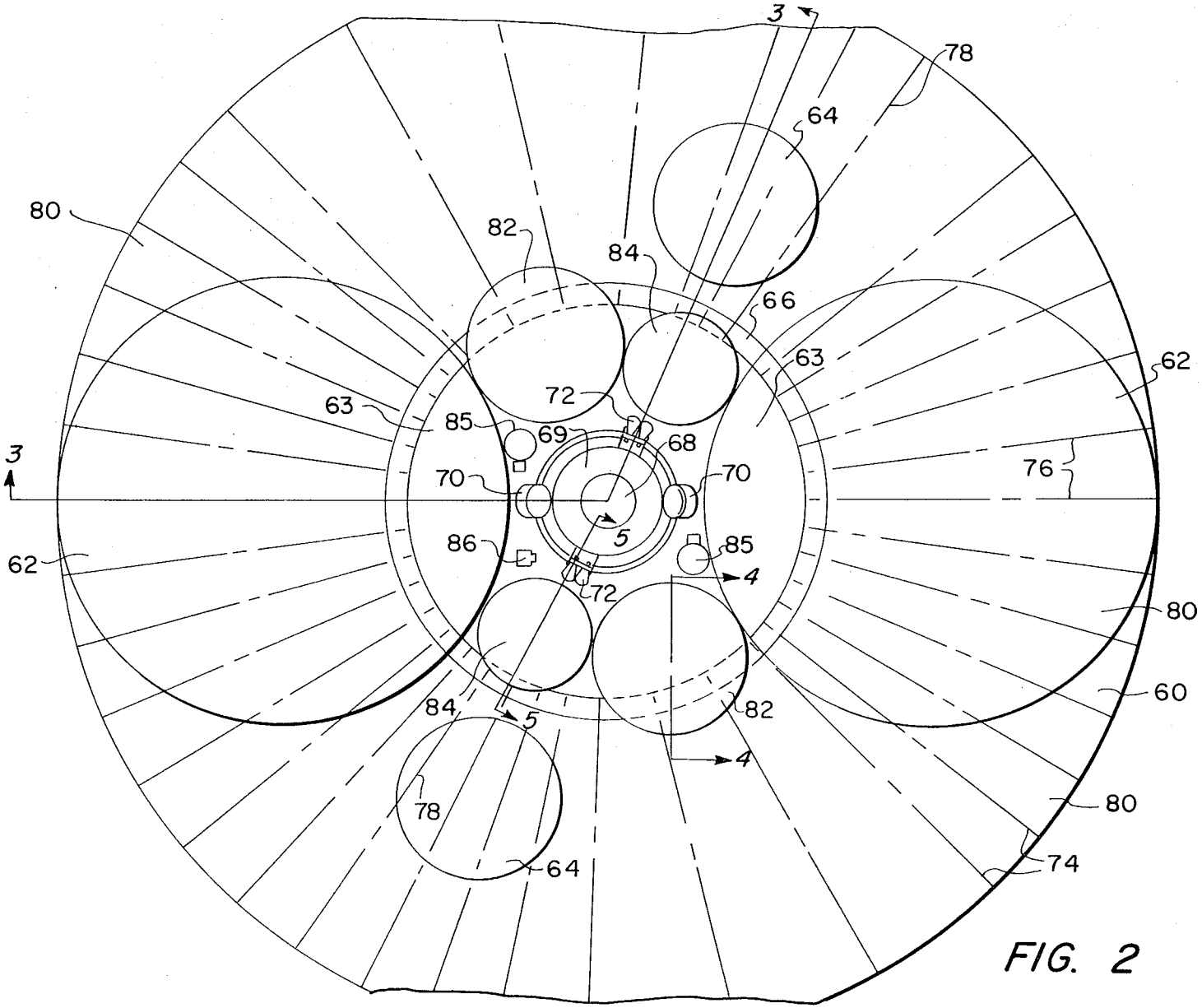
FIG. 2 is a plan view of a second embodiment of the invention.

Another embodiment of the invention providing four auxiliary reflectors for two different SHF bands is shown in plan in FIG. 2. A main parabolic reflector 60 for signals in the UHF band has two portions of its surface deformed to provide a pair of diametrically opposed auxiliary reflectors 62 for signals in a first SHF band. Two additional portions of the surface of main reflector 60 are deformed to provide two additional auxiliary reflectors 64 spaced 180° apart for signals in a second SHF band. Main reflector 60 is a flexible rib antenna with a diameter of about twenty-four feet and may be stowed in a toroidal container 66. When main reflector 60 is deployed as shown in FIG. 2, the flexible ribs are supported by torus 66. Because the apertures of SHF auxiliary reflectors have a diameter of ten feet and extend into the space within torus 66, each auxiliary reflector 62 is provided with a fixed, rigid reflector extension 63 mounted on torus 66. This is best seen in FIGS. 2, 3 and 6.

Referring to FIG. 3, the UHF feed for main reflector 60 is housed within a cup 68 supported on a cylindrical randome 69 formed of fiberglass. As is known in the art, the UHF feed may comprise a cavity backed helix antenna element (not seen) or any other appropriate feeding arrangement. Randome 69 is supported on mounting struts or legs 88 mounted, as will be explained below, on a mounting structure in the space within torus 66. The side walls of cup 68 support the SHF feeds 70 and 72 for auxiliary reflectors 62 and 64. Each of the SHF feeds 70 comprises a round assembly or cluster of X-band horns, providing multiple narrow beams. These beams are steered electronically at the aperture of an auxiliary reflector 62 by means of a variable power divider. Each of the SHF feeds 72 comprises a fixed cluster of four feed horns which, with an auxiliary reflector 64, provide an earth coverage beam from the spacecraft.

As mentioned above, reflector 60 is formed of a plurality of flexible ribs, the number of which is selected to yield reasonable structural support of the reflecting mesh structure. Ribs 74 are relatively widely spaced in portions of main reflector 60 which fall between auxiliary reflectors 62 and 64 and typically may have an angular spacing of 15°. On the other hand, a greater rib density is required for the higher frequency SHF signals impinging upon auxiliary reflectors 62 and 64. Thus, ribs 76 and 78 extending, respectively, through auxiliary reflectors 62 and 64 have an angular spacing of 7.5°, or double the density of ribs 74. By the same token, the conductive mesh 80 which is supported by ribs 74, 76 and 78 may be relatively coarse with openings of about one inch square in the portions of reflector 60 between auxiliary reflectors 62 and 64; whereas mesh 80 must be much finer with mesh openings of about one-quarter inch at auxiliary reflectors 62 and 64.

A number of additional antennas, which form no part of the present invention, are also mounted in the antenna system shown in FIG. 2. These include a pair of crosslink antennas 82, spaced 180° apart, a pair of narrow beam FHF antennas 84, spaced 180° apart, a pair of earth coverage EHF antennas 85 spaced 180° apart, and an earth sensor 86. Referring to FIG. 4, crosslink antenna 82 is pivotally mounted on a support 110 projecting from spacecraft 104. In FIG. 5, narrow beam EHF antenna 84 is pivotally mounted on spacecraft 104. The feed 112 for antenna 84, is mounted on a strut 114 projecting from spacecraft 104; feed 112 is not seen in FIG. 2, because it is hidden by randome 69.

As best seen in FIG. 6, spacecraft 104 supports an antenna hub ring 108 which, by means of struts 106, supports torus 66. It is to be noted that support struts or legs 88 for radome 69 are mounted on antenna hub ring 108.

Turning again to FIG. 3, it is seen that the curvature of the surface of main reflector 60 is deformed by displacing the surface in a direction parallel to the axis of reflector 60 to form the surface of auxiliary reflectors 62 and 64. The dash line 102 represents the curvature of the surface of main reflector 60 before modification. As will be explained in more detail hereinafter, important parameters in determining the position and configuration of auxiliary reflectors 62 and 64 relate to the positions of the focal point 90 of UHF main reflector 60, the focal point 92 of SHF auxiliary reflector 62, the focal point 94 of SHF auxiliary reflector 64, the vertex 96 of main UHF reflector 60, the vertex 98 of auxiliary SHF reflector 62, and the vertex 100 of auxiliary SHF reflector 64.

In the case of a simple UHF reflector of the type shown, which is not modified to provide one or more auxiliary SHF reflectors, there is a certain acceptable level of RMS surface error associated with the structure of the ribs and mesh. When this UHF reflector is modified to incorporate one or more SHF auxiliary reflectors according to the principles of the present invention, there is some sacrifice due to the additional deformation of the surface for the UHF signal which result in degradation of the UHF performance. However, the performance of the SHF auxiliary reflectors are not degraded. In designing the auxiliary SHF reflectors, therefore, it is the object to minimize the degradation of the main reflector for UHF signals. The design must also, of course, make due allowance for the physical constraints of the system which include the necessity to mount the feed horn assemblies for the auxiliary reflectors sufficiently to the side of the UHF feed.

Figure 7:
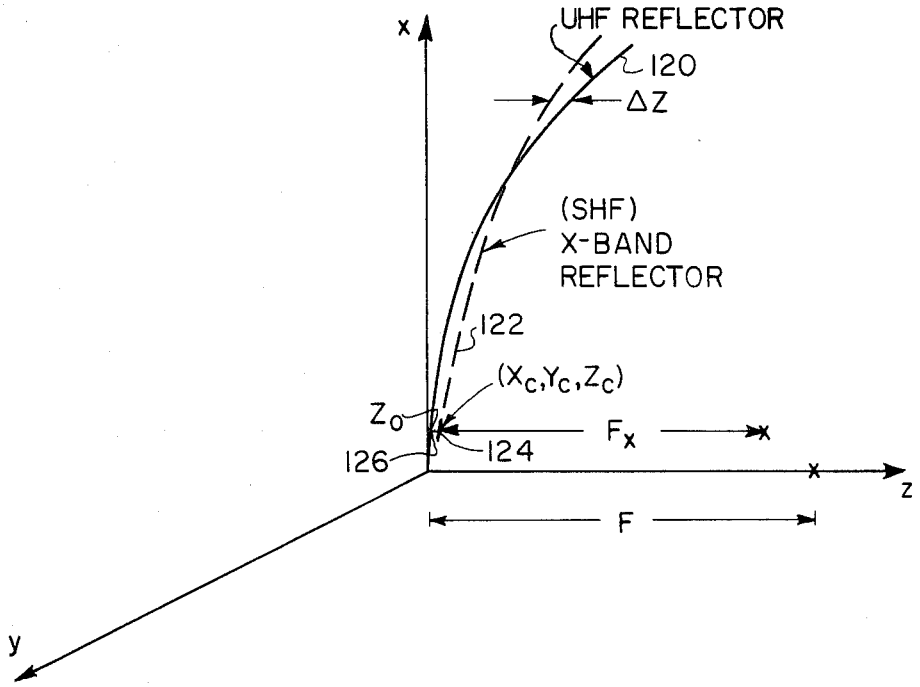
FIG. 7 is a diagram illustrating the design of an auxiliary reflector of the invention.

As illustrated in FIG. 7, the design of the surface of the auxiliary SHF, or X-band, reflector 122 involves computing the displacement $\Delta Z$ in the Z-coordinate direction parallel to the axis, or bore sight, of the main reflector from the surface 120 of the unmodified main UHF reflector. This computation is a function of the number of variables. These include $X_c$, the distance in the X-coordinate direction between the vertex and focal point of the auxiliary reflector and the axis of the main reflector which is coincident with the line between the focal point 90 and vertex 96 (FIG. 3); $Y_c$, the distance in the Y-coordinate direction between the vertex and focal point of the auxiliary reflector and the axis of the main reflector; $Z_c$, the distance in the Z-coordinate direction between the vertex of the auxiliary reflector and the vertex of the main reflector; F, the focal length of the main reflector; $F_x$, the focal length of the auxiliary reflector; and $Z_o$, the position in the Z-coordinate direction of the point 126 on the surface 120 of the main UHF reflector corresponding to (having the same X coordinate as) the vertex 124 of auxiliary SHF reflector surface 122, 126 being, in effect, the point on surface 120 from which vertex 124 is displaced. The computation for $\Delta Z$ is governed by the equation:

$$\Delta Z = \frac{X_c X + Y_c Y}{2F} - \left[ Z_o + \frac{F_x Z_c}{F} \right] - Z\left(1 - \frac{F_x}{F}\right),$$

where X, Y and Z are the coordinates in X-, Y- and Z-coordinate directions of a point on the reflector surface, the RMS error is computed from the expression $$\sqrt{\Sigma_{X\text{-}SURF}(\Delta Z)^2/N}$$

where $\Sigma_{X-SURF}$ is a summation of the surface error of the auxiliary SHF (X-band) reflector and N is the number of sampling points taken on the auxiliary reflector to identify its surface roughness.

Figure 8:
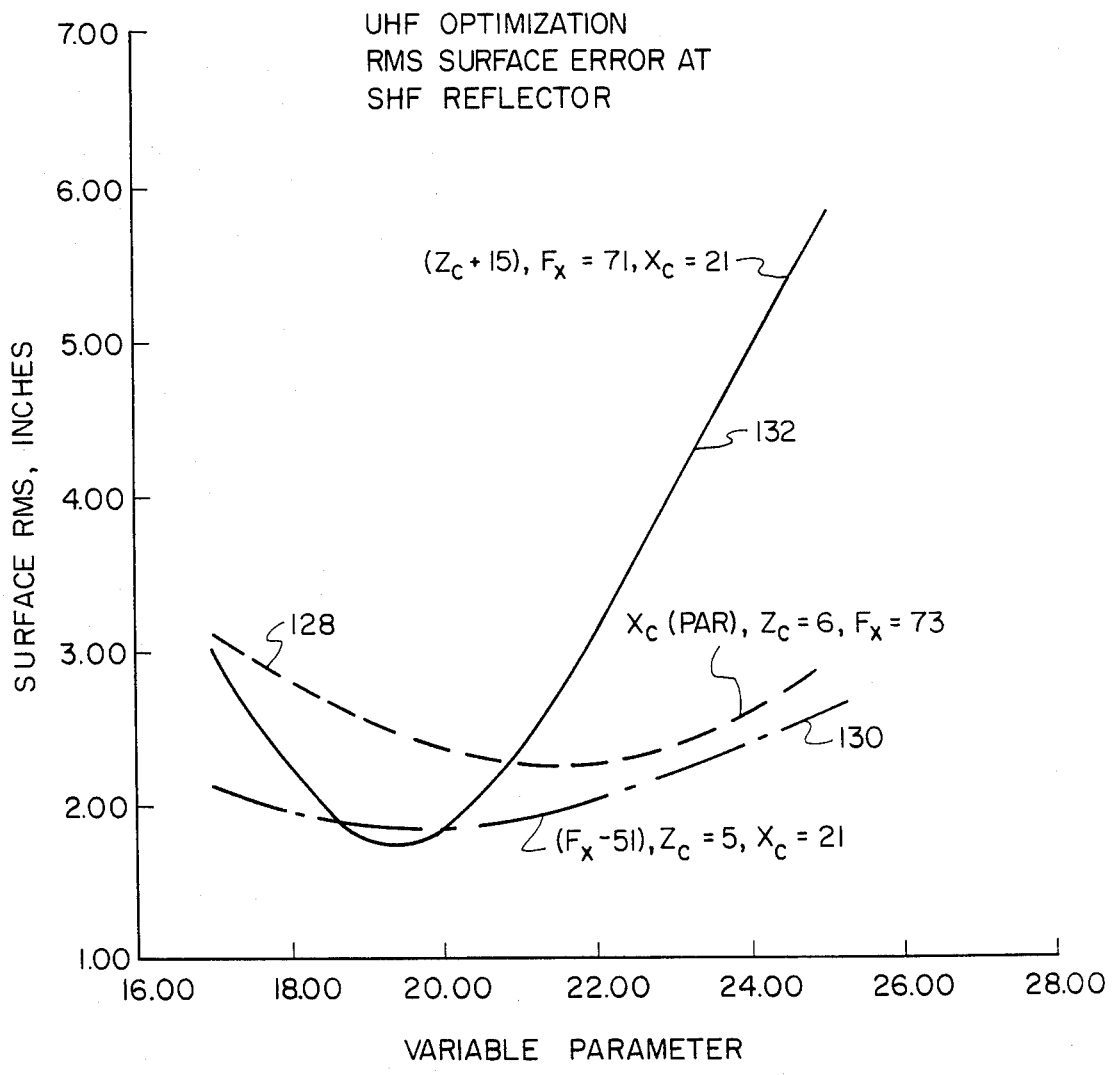
FIG. 8 is a graph illustrating the optimization technique used in designing an auxiliary reflector of the invention.
Figure 10:
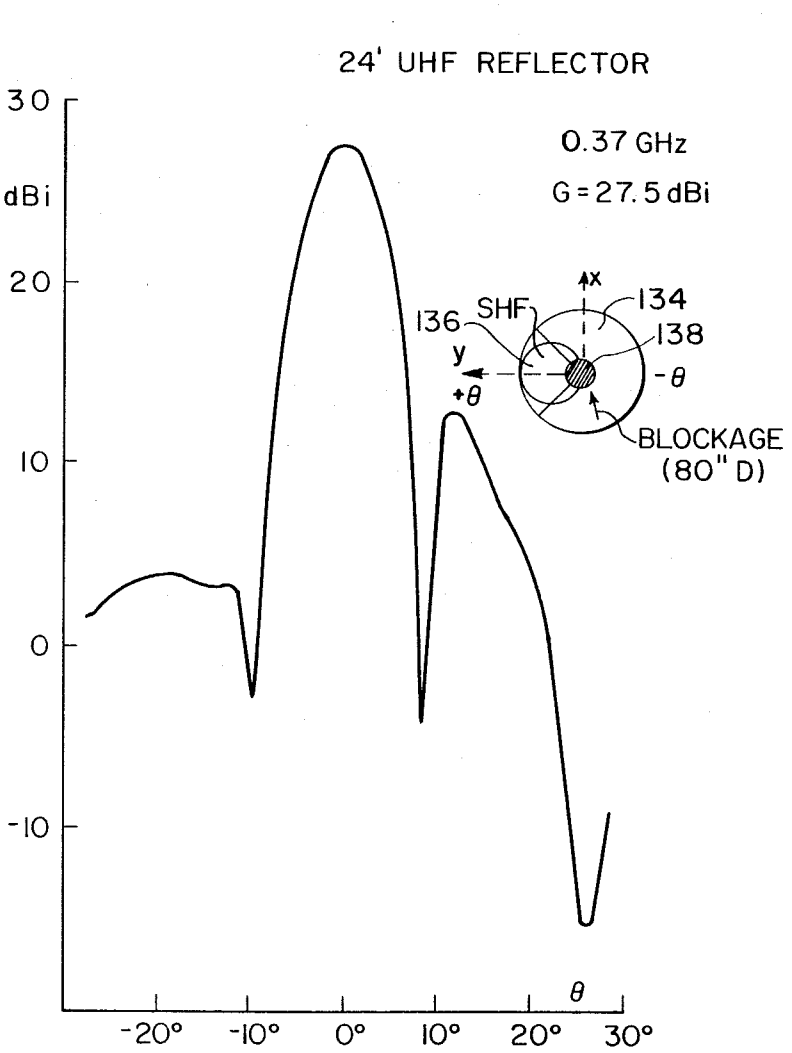
FIGS. 10, 11, 12, 13 and 14 are graphs illustrating the operation of different forms of the invention.

In the optimization of the SHF auxiliary reflector configuration, the parameters $F_x$, $Z_c$ and $X_c$ are varied, one at a time, within the limitations of the location constraints for the feeding arrangements of both reflectors. The computer RMS surface errors at the location of the SHF reflector, referred to the UHF reflector, are plotted in FIG. 8. The variable parameters ($F_x-51''$), ($Z_c+15''$) and $X_c$ have the same scale on the horizontal axis. It can be seen in this figure that the minimum RMS error of 2.25" occurs for curve 128 at $X_c=21''$, with $Z_c=6''$ and $F_x=73''$. The second curve 130 yields a minimum RMS error of 1.845" at $(F_x-51)=19.5''$, (i.e., $F_x=70.5''$), with $Z_c=5''$ and $X_c=21''$. The third curve 132, which shows more critical RMS dependence on the parameter $Z_c$, yields a minimum RMS error of 1.751" at $(Z_c+15)=19.5''$, (i.e. $Z_c=4.5''$). These RMS errors are based on computations for a squared aperture SHF reflector, which approximates the radial shape caused by deployment of the rib structure.

Figure 9:
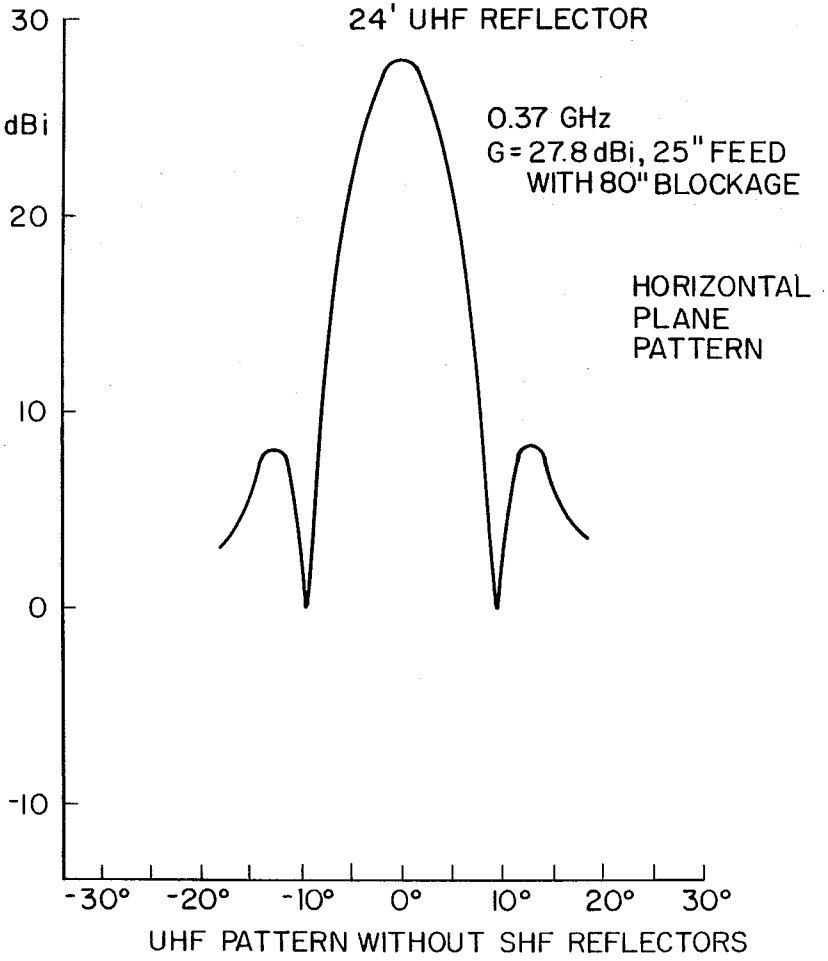
FIG. 9 is a graph illustrating the operation of a simple UHF reflector without an auxiliary SHF reflector of the invention.
Figure 12:
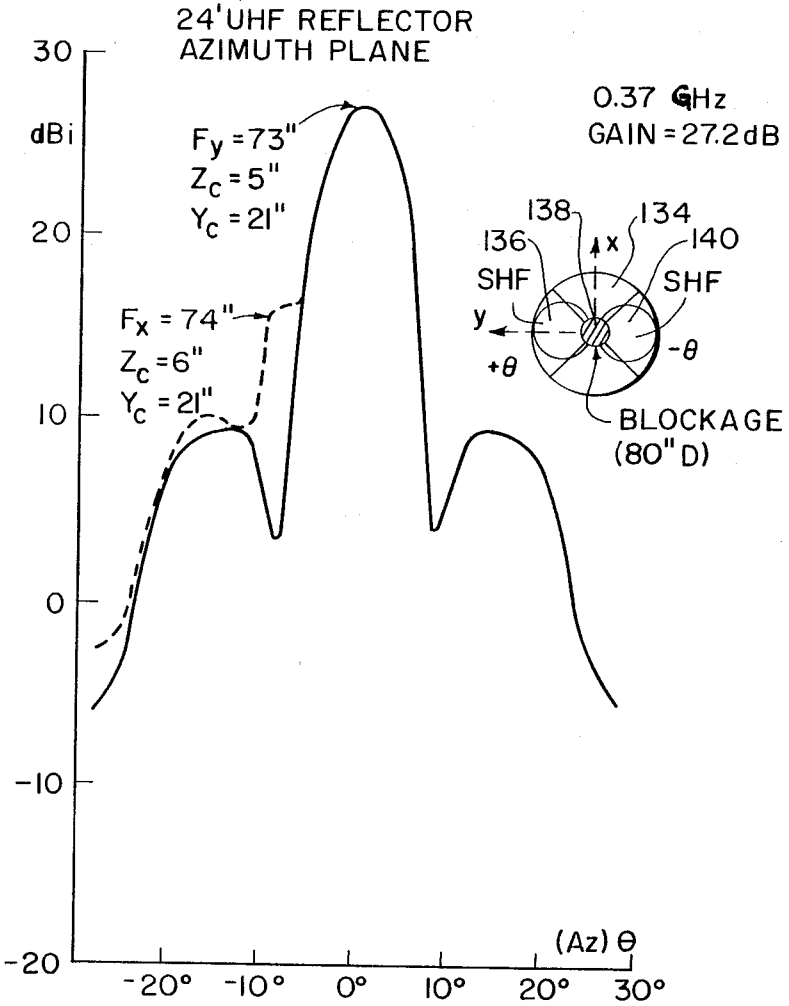
Figure 11:
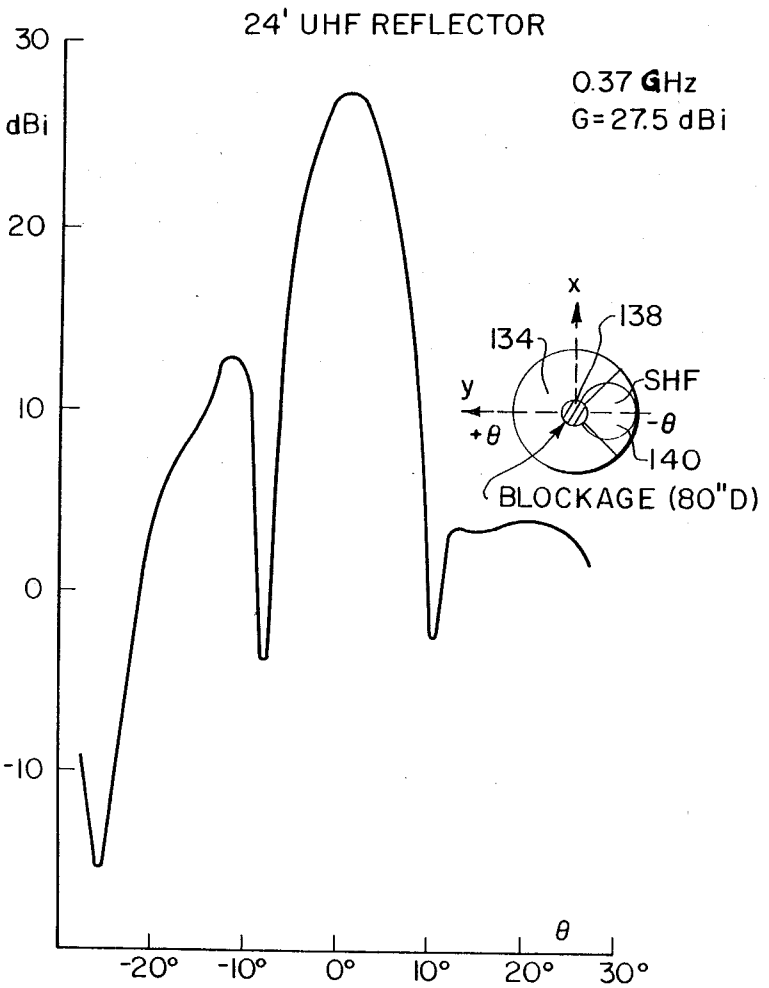
Figure 14:
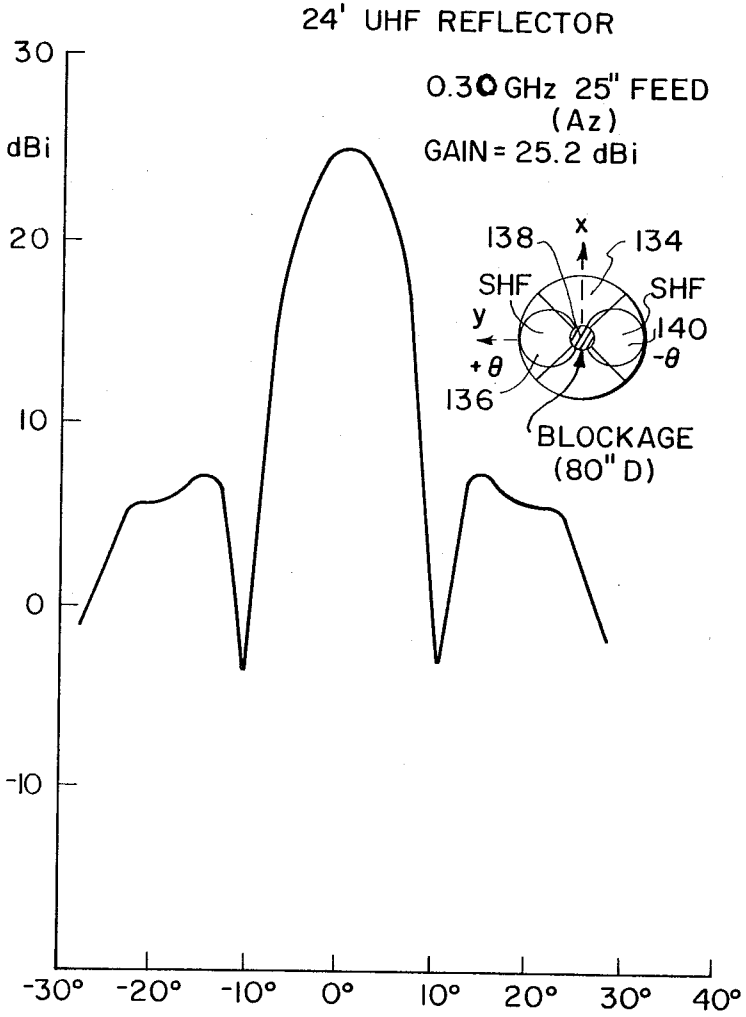
Figure 13:
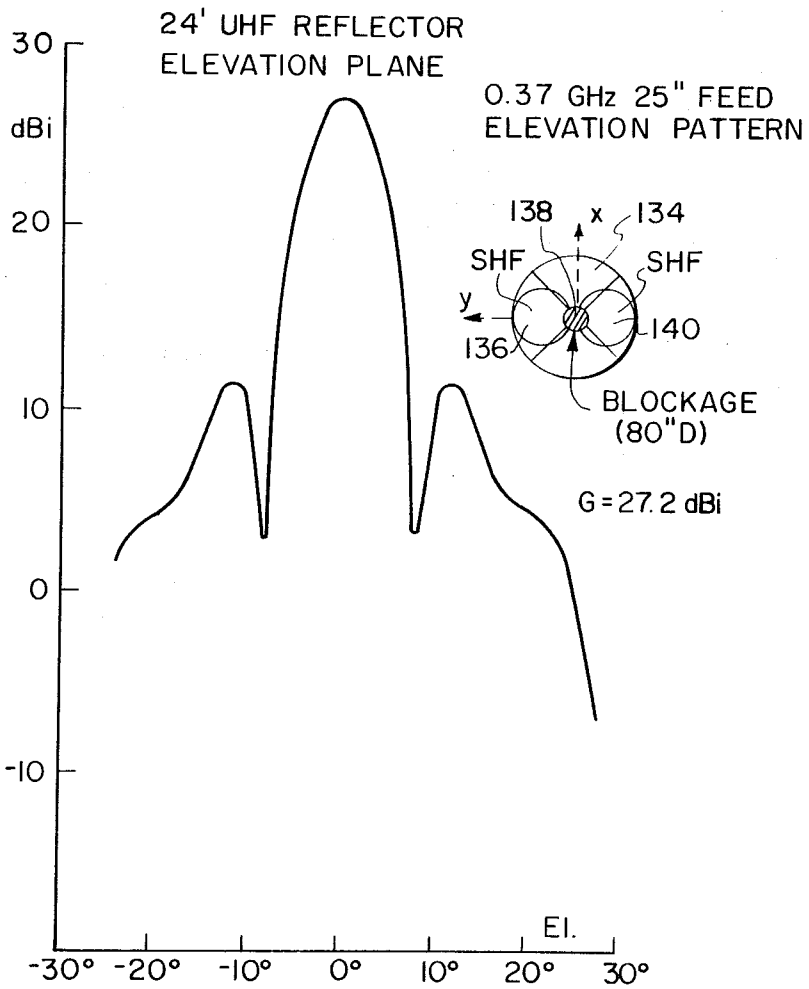

FIG. 9 shows the radiation pattern for a simple UHF reflector which is not modified according to the invention to provide auxiliary SHF reflectors. The radiated frequency was 0.37GH$_z$, and the gain is 27.8 dBi. The curve shows the effect of eighty inches of blockage at the center of the reflector. The pattern is horizontal with horizontal polarization. The feed diameter is twenty-five inches.

Radiation patterns are shown in FIGS. 10, 11, 12, 13 and 14 for reflectors of the invention, of the main beam and sidelobe configurations, respectively, for a main reflector 134 with a single SHF reflector 136 to the left, a single SHF reflector 140 to the right, two SHF reflectors 136 and 140 in azimuth, two SHF reflectors 136 and 140 in an elevation pattern at 0.37 GHz and two SHF reflectors 136 and 140 in an azimuth pattern at 0.3 GHz. It can be seen in these figures that the peak gain of radiation degrades by 0.3 dB for each SHF reflector. The nominal size of the SHF reflector is 10 feet, and the analytical model takes into account all radial reflector deformations including those in one quarter of the UHF reflector area for a single SHF reflector. The patterns include the effects of blockage 138 of 80" at the center and the usual surface errors associated with the UHF and SHF rib configurations. The sidelobe level of the radiation pattern degraded to −10 dB below the peak of the main beam, which is not harmful to the RF radiation requirements for this specific spacecraft application. The main beam is designed to cover the earth from a high orbit, and the sidelobes would fall off the globe. These beams are generated by a single mode, CP circular feed horn, the size of which is equivalent to a spiral feed arrangement. In applications where the sidelobe level is required to be low, feed clusters which handle multiple contiguous beam formations may be used to eliminate the high sidelobe level.

It is to be understood that the principles of the invention are not limited to the embodiments described but are applicable to other antenna structures. For example, the reflector need not be a flexible rib reflector, but may be a rigid reflector configuration. Nor is the antenna of the invention limited to a particular number of auxiliary reflectors. The frequency bands need not be confined to the UHF and SHF bands; only adherence to the principle that the main antenna be for the lowest of the frequency bands used.

Although the invention has been described with reference to particular preferred embodiments, various changes and modifications which are obvious to a person skilled in the art to which the invention pertains are deemed to be within the spirit and scope of the invention as set forth in the appended claims.

The invention claimed is:

1. A multifrequency antenna comprising: a main reflector for signals in a first frequency band, a portion of the surface of said main reflector being deformed in curvature to form an auxiliary reflector for signals in a second frequency band higher than said first frequency band, the deformation of curvature being such as to minimize degradation of the performance of said main reflector.

2. A multifrequency antenna as recited in claim 1, further comprising first feed means for said signals in said first frequency band located at a focal point of said main reflector and second feed means for said signals in said second frequency band located at a focal point of said auxiliary reflector.

3. A multifrequency antenna as recited in claim 2, wherein said focal point of said auxiliary reflector is displayed by a distance $X_c$ from said focal point of said main reflector.

4. A multifrequency antenna as recited in claim 3, wherein the vertex of said main reflector and said focal point of said main reflector are located on the axis of said main reflector, and the vertex of said auxiliary reflector are located on a line parallel to said axis of said main reflector and spaced said distance $X_c$ from said axis.

5. A multifrequency antenna as recited in claim 1, wherein the vertex of said auxiliary reflector is spaced by a distance $X_c$ from the axis of said main reflector.

6. A multifrequency antenna as recited in claim 1, wherein said auxiliary reflector is so located and configured that the degradation of the performance in said first frequency band of said main reflector is minimized.

7. A multifrequency antenna as recited in claim 6, wherein the displacement $\Delta Z$ of the surface of said main reflector in a Z-coordinate direction parallel to the axis of said main reflector is governed by the equation:

$$\Delta Z = \frac{X_c X + Y_c Y}{2F} - \left[ Z_o + \frac{F_x Z_c}{F} \right] - Z\left(1 - \frac{F_x}{F}\right),$$

where

X, Y and Z are the coordinates of points on the surface of said auxiliary reflector in mutually orthogonal X-coordinate, Y-coordinate and Z-coordinate directions;

$X_c$ is the distance in said X-coordinate direction of the focal point and vertex of said auxiliary reflector from said axis of said main reflector;

$Y_c$ is the distance in said Y-coordinate direction of the focal point and vertex of said auxiliary reflector from said axis of said main reflector;

$Z_c$ is the distance in said Z-coordinate direction of the vertex of said auxiliary reflector from the vertex of said main reflector;

$Z_o$ is the position in the Z-coordinate direction on said main reflector from which the point on the auxiliary reflector, corresponding to the vertex of said auxiliary reflector, is displaced;

F is the focal length of said main reflector; and $F_x$ is the focal length of said auxiliary reflector.

8. A multifrequency antenna as recited in claim 7, wherein the RMS error for said first frequency band at said auxiliary reflector is governed by the equation:

$$\text{RMS ERROR} = \sqrt{\Sigma_{X\text{-}SURF}(\Delta Z)^2/N},$$

where $\Sigma_{X-SUR}$ is a summation of the surface of the auxiliary reflector and N is the number of sampling points taken on said auxiliary reflector to identify its surface roughness.

9. A multifrequency antenna as recited in claim 8, wherein said first frequency band is in the UHF band and said second frequency band is in the SHF band.

10. A multifrequency antenna as recited in claim 9, wherein said RMS error is 1.8 inches, $X_c$ is 21 inches, $Y_c$ is 0 inch, $Z_c$ is 5 inches, $F_x$ is 71 inches, and F is 87.6 inches.

11. A multifrequency antenna as recited in claim 1, wherein said first frequency band is in the UHF band and said second frequency band is in the SHF band.

12. A multifrequency antenna as recited in claim 1, wherein other portions of said main reflector are deformed to form other auxiliary reflectors for signals in third and/or higher frequency bands.

13. A multifrequency antenna as recited in claim 12, wherein said first frequency band is in the UHF band and said second and third frequency bands are in the SHF band.

14. A multifrequency antenna as recited in claim 1, wherein said main reflector is formed with a rib structure and said auxiliary reflector has a larger rib density than the portion of said main reflector which is not deformed to form an auxiliary reflector.

15. A multifrequency antenna as recited in claim 1, wherein the vertex of said auxiliary reflector is laterally and axially offset from the vertex of said main reflector, and wherein said offsets and the focal length of said auxiliary reflector are selected to minimize the degradation of the performance of said main reflector in said first frequency band.

* * * * *